US009536684B2

(12) United States Patent
Pizzato et al.

(10) Patent No.: US 9,536,684 B2
(45) Date of Patent: Jan. 3, 2017

(54) MULTIPLE SIGNALING HINGED SAFETY SWITCH FOR MOBILE PROTECTION BARRIERS

(71) Applicant: PIZZATO ELETTRICA SRL, Marostica (VI) (IT)

(72) Inventors: Marco Pizzato, Marostica (IT); Giuseppe Pizzato, Marostica (IT)

(73) Assignee: PIZZATO ELETTRICA S.R.L., Marostica (VI) (IT)

( * ) Notice: Subject to any disclaimer, the term of this patent is extended or adjusted under 35 U.S.C. 154(b) by 399 days.

(21) Appl. No.: 14/377,162

(22) PCT Filed: Dec. 23, 2013

(86) PCT No.: PCT/IB2013/061270

§ 371 (c)(1),
(2) Date: Aug. 6, 2014

(87) PCT Pub. No.: WO2014/102704

PCT Pub. Date: Jul. 3, 2014

(65) Prior Publication Data

US 2015/0022027 A1 Jan. 22, 2015

(30) Foreign Application Priority Data

Dec. 28, 2012 (IT) ..... VI2012A0344

(51) Int. Cl.
*H01H 3/16* (2006.01)
*E05D 11/00* (2006.01)
*H01H 3/42* (2006.01)

(52) U.S. Cl.
CPC ..... *H01H 3/162* (2013.01); *E05D 11/0081* (2013.01); *H01H 3/42* (2013.01)

(58) Field of Classification Search
CPC ..... H01H 3/162; H01H 3/42; E05D 11/0081
(Continued)

(56) References Cited

U.S. PATENT DOCUMENTS 4,049,934 A * 9/1977 Newlon ..... E05D 11/00 200/61.7
4,066,857 A * 1/1978 Suska ..... E05D 11/00 200/332.1

(Continued)

FOREIGN PATENT DOCUMENTS

GB 2150757 7/1985

*Primary Examiner* — Jared Fureman
*Assistant Examiner* — Michael Warmflash
(74) *Attorney, Agent, or Firm* — Themis Law

(57) ABSTRACT

A multi-signaling hinged safety switch for mobile protection barriers includes a fixed member designed to be secured to a stationary part of the barrier and having a pair of axial end holes, a movable member designed to be secured to a pivotal part of the barrier and having a pair of substantially transverse arms located outside the fixed member and pivoted to the axial end holes, an electrical detection system within the fixed member switching one or more electric safety circuits of the barrier at a predetermined switching angle. A pair of cylindrical pins extend in cantilever fashion from the arms and are pivotally inserted in the holes, with mutually spaced opposed ends defining a gap with no axial connection member therein. The detection system includes a pair of detectors each interacting with one end of a pin and having a switching angle that are operatively independent of each other.

11 Claims, 6 Drawing Sheets

(58) Field of Classification Search
USPC ..... 307/326
See application file for complete search history.

(56) References Cited

U.S. PATENT DOCUMENTS

| | | | | |
|---|---|---|---|---|
| 4,802,605 | A * | 2/1989 | Salmon | G06F 1/1681 16/267 |
| 9,418,522 | B2 * | 8/2016 | Pizzato | H01H 3/162 |
| 2007/0068778 | A1 * | 3/2007 | Ulfik | E05D 11/00 200/6 R |

* cited by examiner

MULTIPLE SIGNALING HINGED SAFETY SWITCH FOR MOBILE PROTECTION BARRIERS

FIELD OF THE INVENTION

The present invention generally finds application in the field of electric safety devices and particularly relates to a multi-signaling hinged safety switch for mobile protection barriers.

BACKGROUND ART

Safety switches are known to be used for monitoring personnel access to an area delimited by protection barriers, and containing hazardous materials, mechanical moving parts and/or electric power devices.

Particularly, hinged safety switches have a casing designed to be secured to the fixed part of the protection barrier and a movable member designed to be connected to the door of the barrier.

The casing houses an electric contact unit connected to one or more electric safety circuits and adapted to cause one or more electric contacts to open and/or close upon rotation of the movable part relative to the fixed enclosure.

This configuration affords the movable part of the barrier to be opened or closed by detection of the electric quantities of the signals in the safety circuits.

A need is particularly felt in the art for hinged safety switches that can generate redundant electric signals as a function of whether the barrier is opened and/or closed.

The generation of such redundant signals increases installation flexibility of the switch and provides improvements in switch safety.

This is because the generation of redundant signals may prevent wrong barrier-open and/or barrier-closed signaling, caused by flickering of the contacts of the electric unit of by transient electric arcs formed therebetween or by malfunctioning thereof.

Furthermore, the generation of redundant signals associated with barrier opening and/or closing is often required by standards that regulate the field of electric plants and safety.

Hinged electric devices that accommodate two distinct electric contact units therein have been developed to manufacture this kind of safety switches.

GB2150757 discloses a hinged switch comprising a through central pin about which the movable part pivots, and a pair of electric contact units, disposed within the casing. The electric units have a first portion integral with the casing and a second portion adapted to be connected to the external safety circuit, and attached to the movable part of the switch via two pairs of screws.

As the barrier is opened and/or closed, the portions of each unit are caused to mutually pivot about the pin, with the electric contacts being consequently switched.

Thus, as the barrier is opened and/or closed, two redundant electric signals are generated in the electric safety circuits associated with the contact units.

While such hinged device generates redundant electric signals as a function of whether the barrier is opened or closed, it still suffers from a few recognized drawbacks.

A first drawback is that the electric portions of each contact unit are connected to the movable part via screws, and this may considerably reduce the overall safety of the switch.

Indeed, should the screws be removed or broken, the movable part of the switch can still pivot relative to the fixed casing about the central pin but cannot cause the electric contacts to also pivot relative to each other.

As a result, in case of failure of the screws, the operator would be allowed to access the area delimited by the barrier, and as the latter is opened or closed there would be no change in the electric signals associated with the safety circuits.

A further drawback is that the construction of this switch is particularly complex, as it requires a great number of parts and relatively long assembly times.

Also, these switches require the use of contact units having a central hole for the passage of the through pin, and for this reason they must be selected from a restricted group of commercially available contacts.

Another significant drawback of the present invention is that any failure of the central pin might cause separation of the movable part from the casing, which would make the switch useless.

DISCLOSURE OF THE INVENTION

The object of the present invention is to overcome the above drawbacks, by providing a multi-signaling hinged safety switch for mobile protection barriers that is highly efficient and relatively cost-effective.

A particular object of the present invention is to provide a multi-signaling hinged safety switch that can generate redundant electric signals as a function of whether the protection barrier is opened and/or closed.

Another object of the present invention is to provide a multi-signaling hinged safety switch that is particularly sturdy and ensures high safety and reliability.

A further object of the present invention is to provide a multi-signaling hinged safety switch that has a small number of parts, said parts being easy to assemble.

Yet another object of the present invention is to provide a multi-signaling hinged safety switch that comply with current standards concerning electric safety devices, particularly the standards EN ISO 13489-1 and IEC 62061 which allow the switch to be rated as classes 4 , PLe and SIL3.

A further object of the present invention is to provide a multi-signaling hinged safety switch that allows the use of a wide variety of readily available electric contact units.

These and other objects, as better explained hereinafter, are fulfilled by a multi-signaling hinged safety switch for mobile protection barriers of machines and/or automatic plants, as defined in claim 1, which comprises a substantially box-like fixed member designed to be secured to a stationary part of a barrier, said box-like member having a longitudinal axis with a pair of axial end holes, a movable member designed to be secured to a protection barrier having a pair of substantially transverse arms located outside said fixed member and pivoted to said axial end holes, and electrical detection means located inside said box-like member for switching one or more electrical safety circuits of said barrier at a predetermined switching angle.

The switch is characterized by a pair of cylindrical pins that are fixed in cantilever fashion to said arms and are pivotally inserted in said holes, said pins having mutually spaced opposed ends defining a gap with no axial connecting member therein, in which said detection means are interposed, wherein said detection means comprise a pair of detectors, each interacting with said end of a respective pin and having a respective switching angle and wherein said detectors are operatively independent of each other.

Advantageous embodiments of the invention are obtained in accordance with the dependent claims.

BRIEF DESCRIPTION OF THE DRAWINGS

Further features and advantages of the invention will be more apparent upon reading of the detailed description of a preferred, non-exclusive embodiment of a hinged safety switch for mobile protection barriers according to the invention, which are described as a non-limiting example with the help of the annexed drawings, in which.

DETAILED DESCRIPTION OF A PREFERRED EMBODIMENT

Referring to the above mentioned figures, a multi-signaling safety switch of the invention, generally designated by numeral 1, is designed to be mounted to protection barriers B designed for safety of machines and automatic plants.

Particularly, the hinged switch 1 may be also used to warn that an operator has accessed a monitored area, delimited by one or more protection barriers B, such as a building site or a warehouse of hazardous materials.

Figure 1:
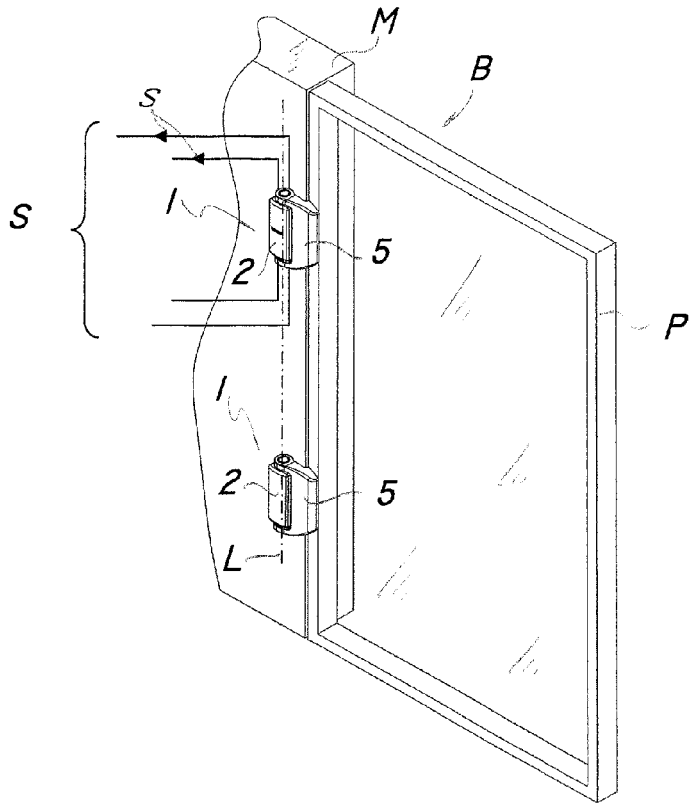
FIG. 1 is a perspective view of a first embodiment of a safety switch of the invention, when installed on a protection barrier.
Figure 2:
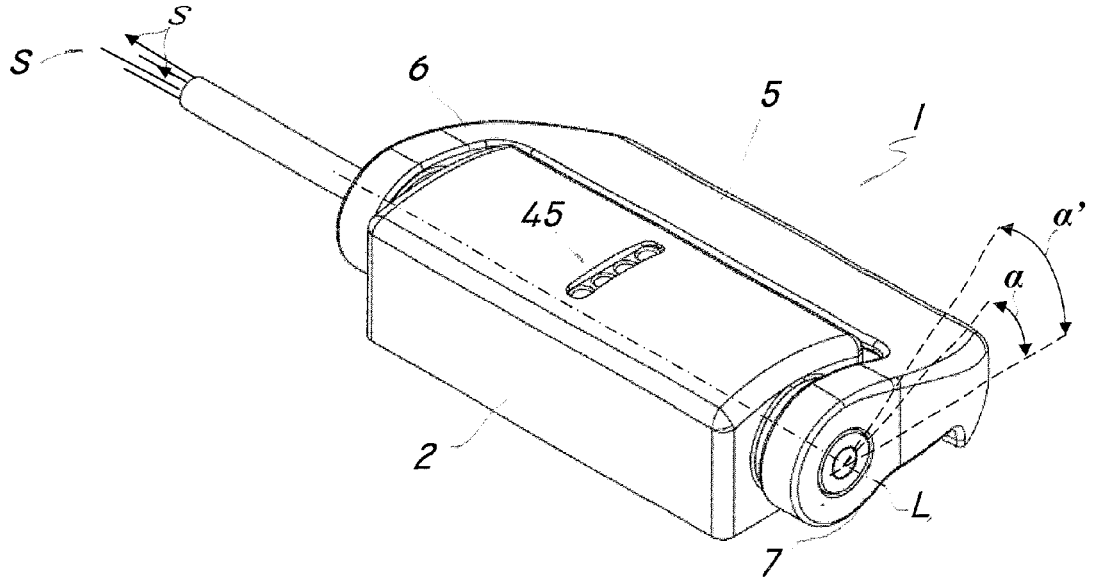
FIG. 2 is a perspective view of the safety switch of FIG. 1.

The protection barrier B, as best shown in FIG. 1, may comprise a stationary part M which is designed to be secured to the machine or the ground, and a movable part P, such as a panel or a door, which is connected to the stationary part M and is adapted to allow access by an operator.

The switch 1 may be electrically connected to one or more electric safety circuits S and may be designed to send appropriate electric signals s therethrough, which are a function of whether the door P of the barrier B is opened and/or closed.

The switch 1 of the invention comprises a substantially box-like fixed element 2, which is designed to be secured to the stationary part M of the barrier B defining a longitudinal axis L with a pair of axial holes 3, 4.

Also, a movable member 5 is provided, which is designed to be secured to the pivotal part P of the protection barrier B and has a pair of substantially transverse arms 6, 7 located outside the fixed member 2 and pivoted to the axial end holes 3, 4.

The switch 1 comprises electric detection means 8 located inside the fixed box-like member 2 and adapted to switch one or more electric safety circuits S of the barrier B at a predetermined switching angle $\alpha$.

The switch 1 may comprise a pair of electric inputs, not shown, and a pair of electric outputs, also not shown, for connection with at least one safety circuit S.

According to a peculiar feature of the invention, the switch 1 comprises a pair of pins 9, 10, which are fixed in cantilever fashion to the arms and are pivotally inserted in the holes 3, 4.

The pins 9, 10 have mutually spaced opposed ends 11, 12 defining a gap or interspace 13 with no axial connection member therein.

Furthermore, the detection means 8 comprise a pair of detectors 14, 15 each interacting with one end 11, 12 of a respective pin 9, 10 and having a respective switching angle $\alpha$, $\alpha'$.

Suitably, the detection means 8 may be placed within the gap 13.

The detectors 14, 15 are operatively independent of each other and may also be adjusted, separately from or in combination with each other, to change their respective switching angle $\alpha$, $\alpha'$.

Suitably, the switching angle $\alpha$, $\alpha'$ may coincide with the angle of rotation of the respective pin 9, 10, and the detectors 14, 15 may have equal or different switching angles $\alpha$, $\alpha'$.

For example, the provision of detectors 14, 15 with different switching angles $\alpha$, $\alpha'$ will allow respective electric safety circuits S to be closed and/or opened with a predetermined delay.

Nevertheless, the detectors 14, 15 may have substantially equal switching angles $\alpha$, $\alpha'$ with substantially null delay.

The provision of a pair of detectors 14, 15 will afford the generation of independent and redundant electric signals on the electric safety circuits S, associated with the movement of the pivotal part P of the barrier B.

Such generation of redundant signals s will afford particularly safe determination of the open and/or closed position of the door P of the barrier B by the switch 1.

Thus, the generation of at least one pair of redundant electric signals s associated with the independent pivotal movement of each pin 9, 10, will allow the switch to maintain full function even when an anomaly occurs at one of the pins 9, 10 or at one of the arms 6, 7 of the movable member 5.

For example, the switch 1 may provide proper signaling that the pivotal part P of the protection barrier B has been opened and/or closed even when one of the pins 9, 10 or one of the arms 6, 7 has been accidentally broken or when the arm 6, 7 has idly pivoted about its pin 9, 10.

Figure 3:
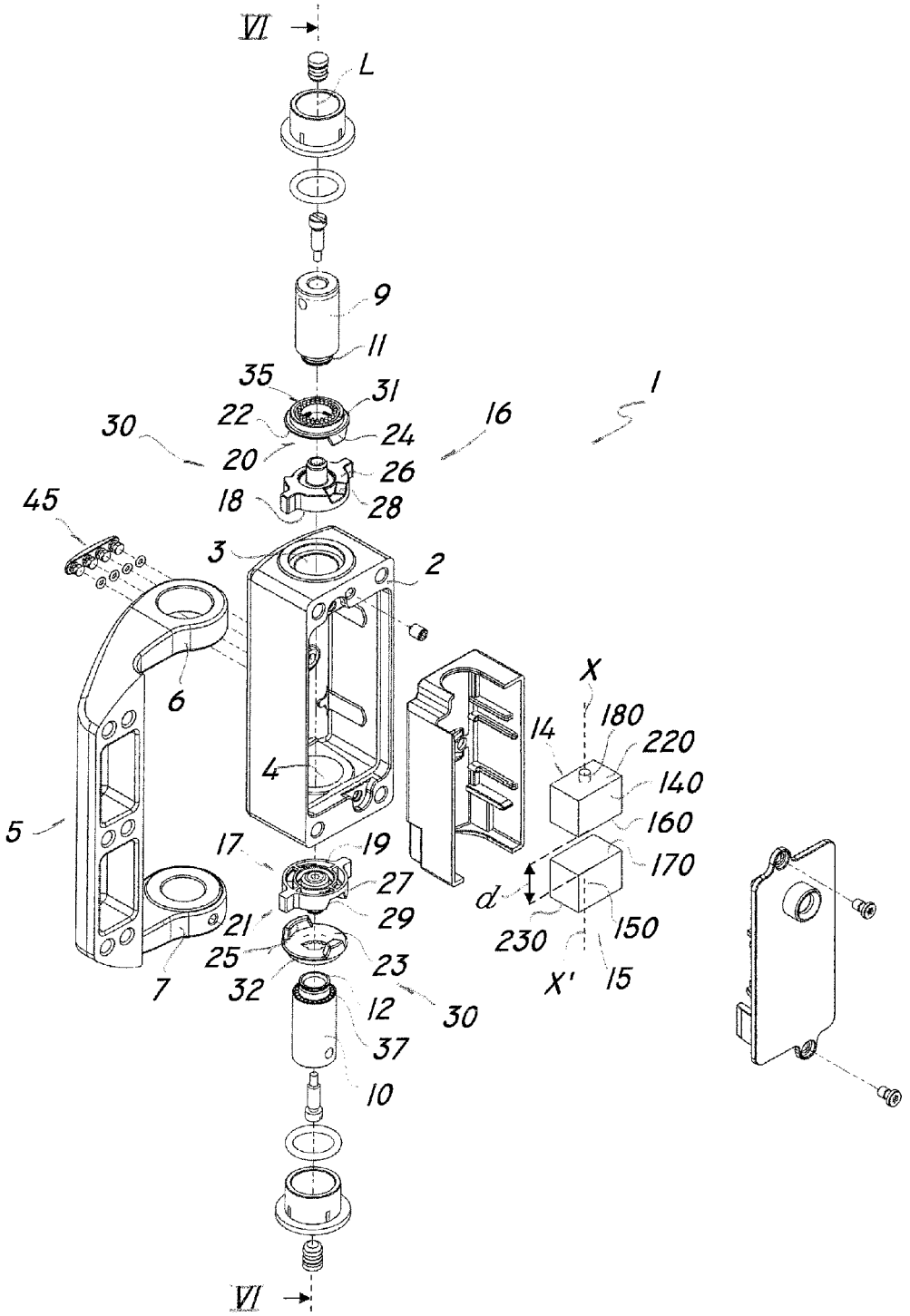
FIG. 3 is an exploded perspective view of a second embodiment of the safety switch with mechanical detectors.
Figure 6:
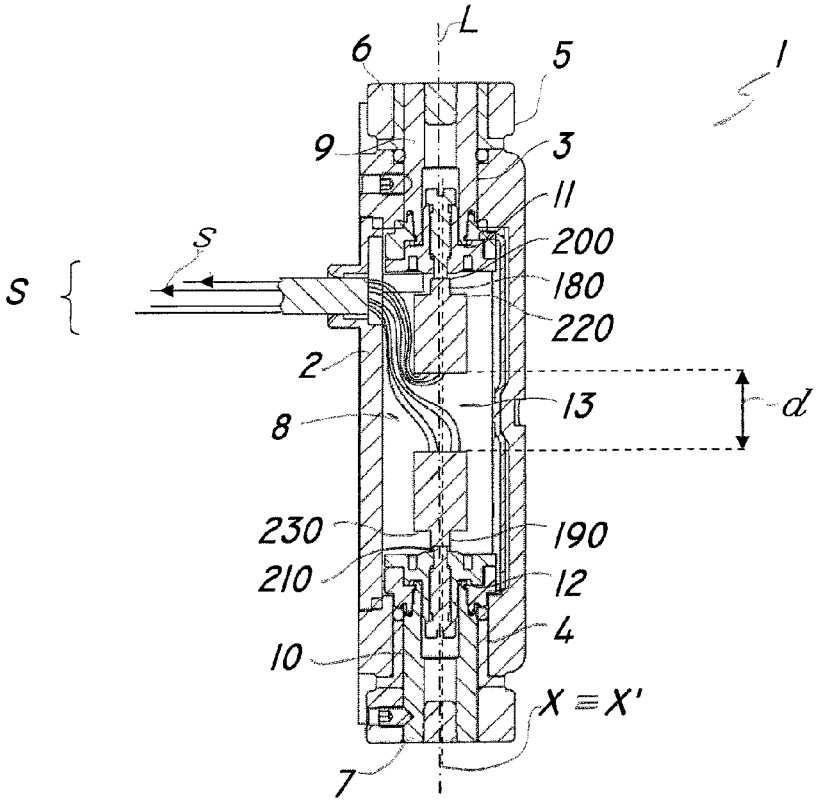
FIG. 6 is a side sectional view of the switch of FIG. 3, as taken along a plane VI-VI.

Conveniently, as best shown in FIGS. 3 and 6, the detectors 14, 15 may be of mechanical type.

For example, the mechanical detectors 140, 150 may be microswitches, relays or other similar devices.

The gap 13 may be of such a size as to allow accommodation of a pair of mechanical detectors 140, 150 having respective mutually facing bottom walls 160, 170, spaced at a predetermined distance d, oriented along the longitudinal axis L.

Particularly, each mechanical detector 140, 150 may comprise a slider 180, 190 moving in a longitudinal direction X, X', with an end 200, 210 projecting out of the upper surface 220, 230 of the detectors 140, 150.

The translational movement of the slider 180, 190 will cause the fixed contacts in the detectors 140, 150 to open or close.

Conveniently, a substantially annular actuator 16, 17, as best shown in FIG. 3, may be interposed between the end 11, 12 of each pin 9, 10 and its respective detector 140, 150, and have an end wall 18, 19 interacting with the detector 140, 150.

Particularly, the actuator 16, 17 may be designed to convert the rotary motion of the pin 9, 10, into an axial motion of the end wall 18, 19.

The end wall 18, 19 of the actuator may be placed in contact with the projecting end 200, 210 of its respective slider 180, 190, to cause axial translation thereof upon rotation of the corresponding end 11, 12 of the pin 9, 10.

Suitably, each actuator 16, 17 may comprise front cam means 20, 21, for converting the rotary motion of the end 11, 12 of the respective pin 9, 10, into a translational motion of the end wall 18, 19. the rotary motion of the pin 9, 10, into a translational motion of the end wall 18, 19.

Particularly, the cam means 20, 21 may comprise a first specially shaped front wall 22, 23, defining a push cam 24, 25.

The cam means 20, 21 may further comprise a complementarily shaped second front wall 26, 2, facing the first front wall 22, 23 and defining a facing cam follower 8, 29 which is designed to interact with the push cam 24, 25.

The rotation of the end 11, 12 of the pin 9, 10 will cause relative rotation of the first front wall 22, 23 and the second front wall 26, 27.

During such rotation the push cam 24, 25 will exert an axial force on the facing cam follower 28, 29 for causing its translational movement in a longitudinal direction X, X'.

The facing cam follower 28, 29 may be operably associated with the end wall 18, 19 of the actuator 26, 27 to cause axial translational motion of the slider 180, 190 during rotation of the pin 9, 10.

Advantageously, the switch 1 may comprise adjustment means 30 for adjusting the switching angle α, α', which are interposed between the actuator 16, 17 and the pin 9, 10, to change the angular position of the end wall 18, 19 relative to the pin 9, 10.

Figure 7:
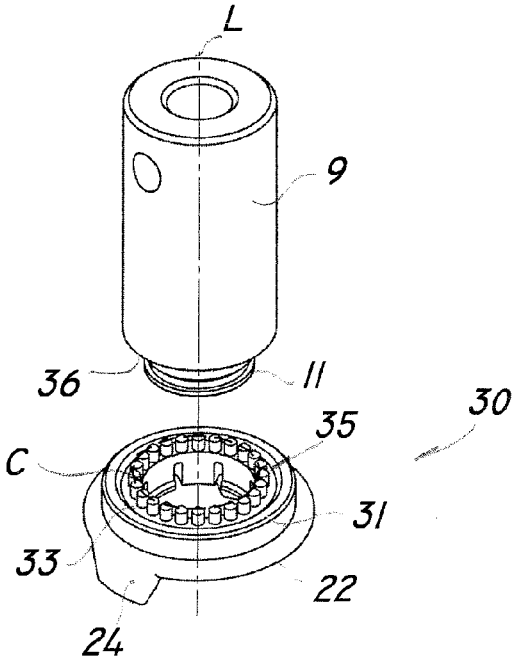
FIG. 7 is an enlarged perspective view of a detail of FIG. 3.

Particularly, the adjustment means 30, as best shown in FIGS. 3 and 7, may comprise an annular member 31, 32 coaxial with the actuator 26, 27 and having a flat surface, as shown in FIG. 7 that shows a single annular member and referenced 33, comprising a series of axial projections, generally designated 35, arranged along a circumference C.

The axial projections 35 may be arranged in evenly spaced relationship along the circumference C.

Also, the axial projections 35 may be designed for selective engagement in corresponding recesses, not shown, formed in the transverse end surface 36, 37 of the pin 9, 10.

During adjustment of the switching angle α, α', the series of axial projections 35 will be released from the corresponding recesses to allow free rotation of the pin 11, 12.

Thus, an operator may rotate the pin 9, 10 during calibration to find the desired switching angle α, α' without causing the latter to act upon the corresponding actuator 16, 17.

Conveniently, the actuator 16, 17 and the adjustment means 30 for adjusting the switching angle α, α' may be as known in the art.

For example, the actuator 16, 17 and the adjustment means 30 for adjusting the switching angle α, α' may be as disclosed in patent IT1362135 granted to the applicant hereof.

Figure 4:
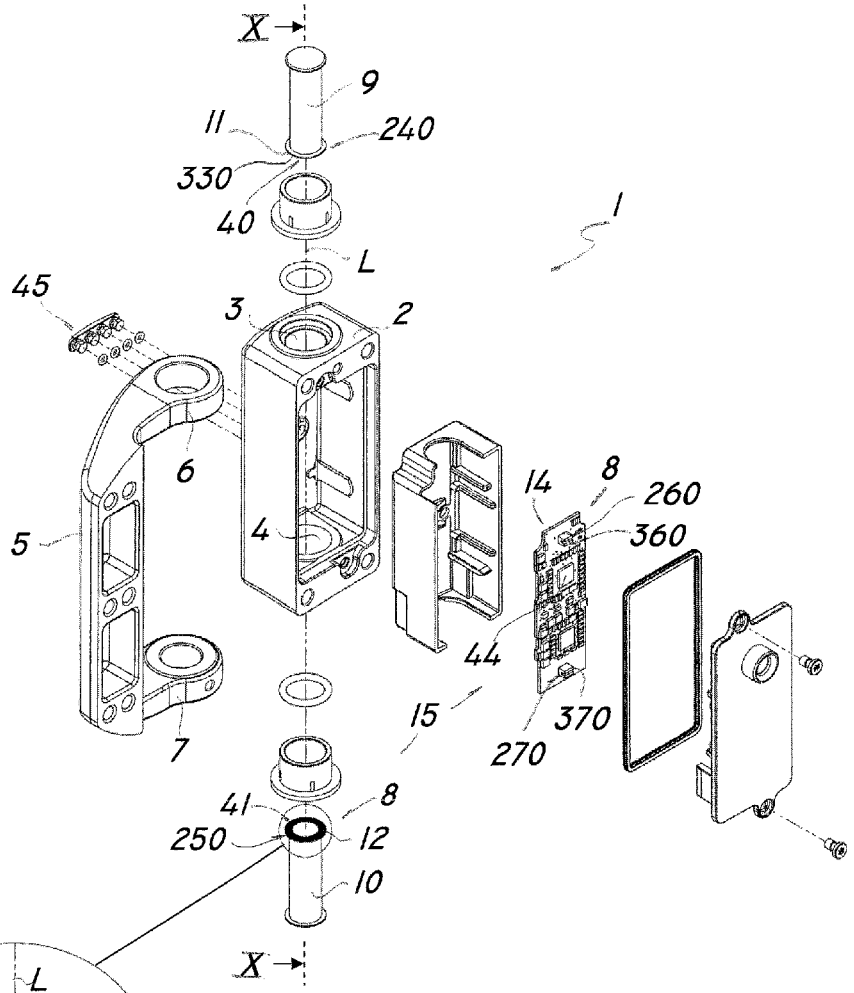
FIG. 4 is an exploded perspective view of a variant of the safety switch with first electronic detectors.
Figure 5:
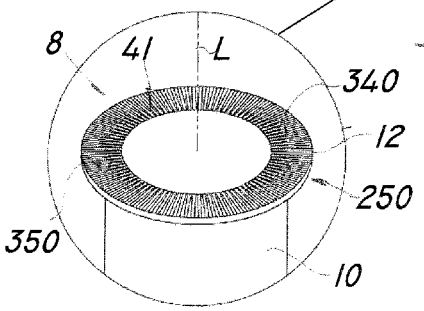
FIG. 5 is a perspective view of an enlarged detail of FIG. 4.
Figure 8:
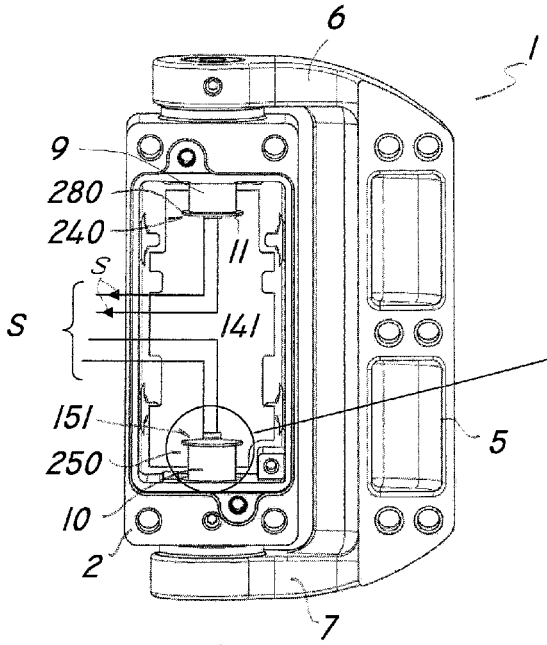
FIG. 8 is a schematized top view of a variant of the safety switch with optical detectors.
Figure 9:
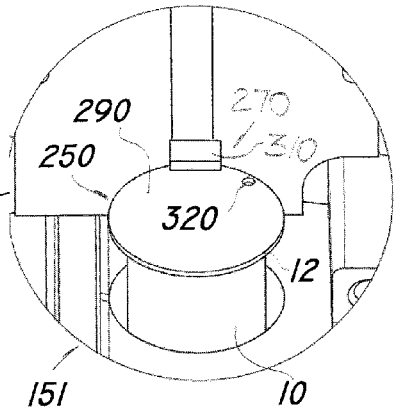
FIG. 9 is a perspective view of an enlarged detail of FIG. 8.

Conveniently, as best shown in FIGS. 8 and 9, the detectors 14, 15 may be of optical type 141, 151 or, as best shown in FIGS. 4 and 5, and in FIGS. 10 to 13, the detectors 14, 15 may be of electronic and/or electromagnetic type 142, 152.

Advantageously, the optical 141, 151, electronic and/or electromagnetic 142, 152 detectors m may comprise a movable portion 240, 250 associated with the end 11, 12 of each pin 9, 10 and a fixed sensor 260, 270 designed to interact with the movable portion 240, 250 and to be secured to the box-like fixed member 2.

Particularly, as best shown in FIGS. 8 and 9, the movable portion 240, 250 of the optical detectors may comprise a disk 280, 290 formed at the end 11, 12 of the respective pin 9, 10.

On the other hand, the fixed sensor 260, 270, may comprise an optical source of the LED type or the like, not shown, and an optical receiver 300, 310 which is adapted to detect the light beam emitted by the optical source.

Conveniently, the disk 280, 290 may be interposed between the optical source and the receiver 300, 310 and may comprise at least one transverse through hole 320 for allowing the passage of the light beam generated by the source.

As the light beam passes through the through hole 320, the receiver 300, 310 will be allowed to detect at least part of the light energy emitted by the source.

Particularly, the light beam may be only detected when the end 11, 12 of the corresponding pin 9, 10 rotates through an angle equal to the switching angle α, α'.

In this condition, the optical detector 141, 151 may generate one or more electric signals s to be sent to the electric safety circuits S.

Conveniently, the electronic and/or electromagnetic detectors 142, 152 as shown in FIGS. 4 and 5 and in FIGS. 10 to 13 may be selected, for instance, from the group comprising angular position transducers.

Particularly, the movable portion 240, 250 of these sensors may comprise an annular portion 330, 340 with uniformly angularly offset grooves, generally referenced 350, for changing an electric and/or electromagnetic field generated by the fixed sensor 360, 370.

Figure 10:
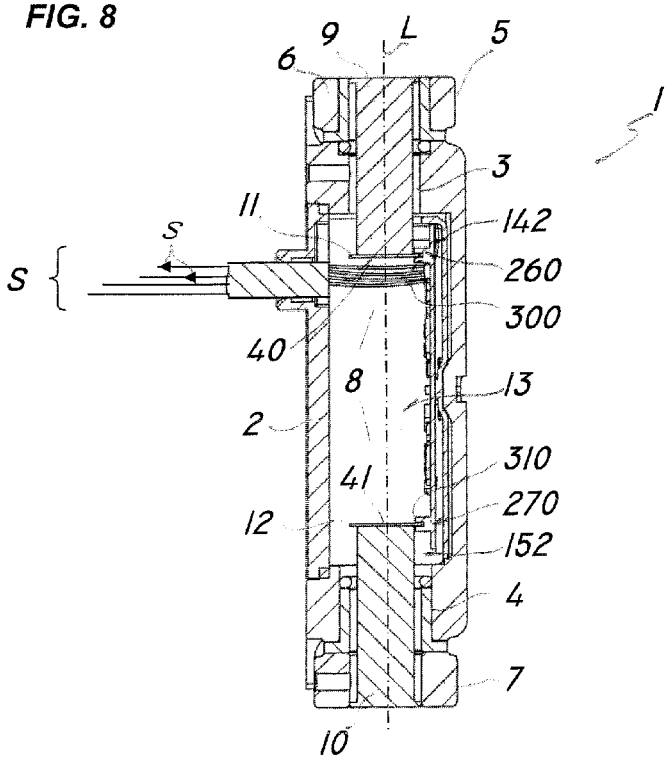
FIG. 10 is a side sectional view of the switch of FIG. 4, as taken along a plane X-X.

Conveniently, these grooves 350 may be formed at a front peripheral end portion 40, 41 of the pin 9, 10, as best shown in FIGS. 4 and 10.

In this case, the fixed sensor 360, 370 is placed before the transverse end surface 36, 37 of the pin 9, 10.

Alternatively, the grooves 350 may be formed at an axial peripheral end portion 42, 43 of the pin 9, 10, and the fixed sensor 360, 370 may be fixed parallel to the pin 9, 10.

Figure 11:
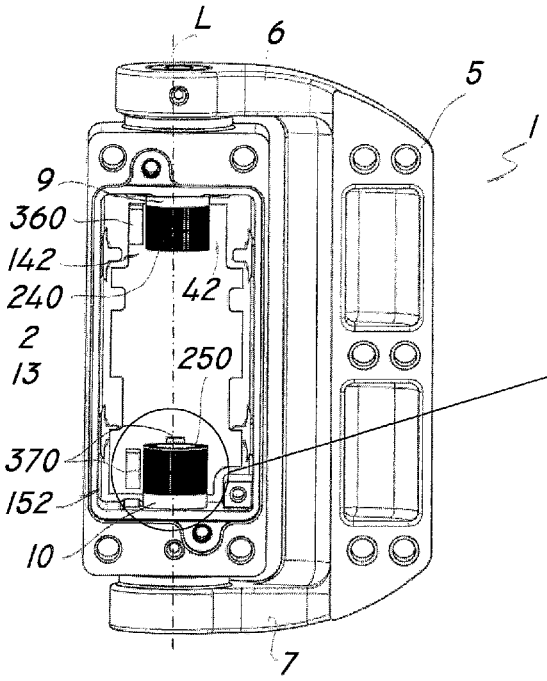
FIG. 11 is a top view of a variant of the safety switch with second electronic detectors.
Figure 12:
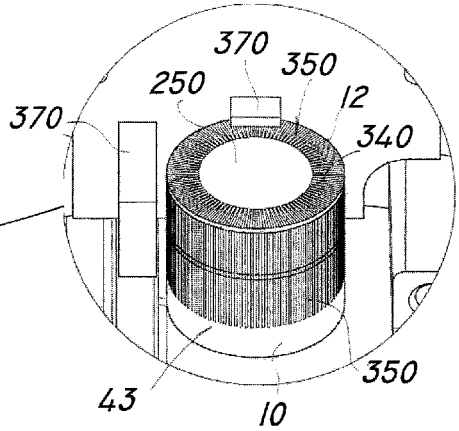
FIG. 12 is an enlarged perspective view of a detail of FIG. 11.

In a further embodiment of the electronic and/or electromagnetic sensor 142, 152, the grooves may be arranged both on the front peripheral end portion 40, 41 and on the axial peripheral end portion 42, 43 of the pin 9, 10, as shown in FIGS. 11 an 12.

Here, the fixed part of the sensor 360, 370 comprises two distinct units, which are respectively fixed to the front and the side of the pin 9, 10.

Of course, the mechanical 140, 150, optical 141, 151, electronic and/or magnetic 142, 152 detectors may differ from those as described before in the type of sliders or sensors in use, in the number of contacts and in the actuation mode or the current-carrying capacity.

Furthermore, the switch 1 may comprise an electronic processing unit 44, as shown in FIG. 4, which is associated with the detection means 8.

Conveniently, the electronic processing unit 44 may be adapted to generate an electric control signal $S_c$, not shown, varying according to the overall number of switching instances by the detectors 14, 15.

Particularly, the electronic processing unit 44 may be associated with the contacts of the mechanical detectors 140, 150 or with the sensor 300, 310; 360, 370 of the optical 141, 151 and electronic 142, 152 detectors respectively.

The electronic processing unit 44 may comprise a storage medium, not shown, for storing at least one reference value associated with a predetermined overall number of switching instances.

Particularly, the electronic processing unit 44 may be designed to detect the overall number of commutations effected by the detectors 14, 15 within a predetermined time interval.

The electronic processing unit 44 may be adapted to compare the number of detected commutations with the reference numerical value stored in the storage media, to generate the control signal $S_c$ according to such comparison.

For example, the electronic processing unit 44 may be adapted to generate a control signal $S_C$, when the switch 1 reaches a total operating time equal to a predetermined factory-preset value.

Conveniently, the processing unit 44 may be either of local type, and be thus accommodated in the box-like fixed part 2, or of remote type, associated with the electric safety circuits S.

The processing unit 44 may be designed to generate additional electric signals, with electric parameters varying according to the instantaneous angular position assumed by the corresponding pin 9, 10.

Conveniently, the electronic processing unit 44 may be adapted to generate data D associated with the operation of the detection means 8.

Furthermore, both the data D and the additional signals may be of digital type, and the switch 1 may accommodate a communication interface, not shown, in the gap 13, for sending the digital signals to the central unit via an electronic connection bus, not shown.

Conveniently, the electronic processing unit 44 and the communication interface may be formed in the same semiconductor support, to form a single integrated device.

Furthermore, the communication interface may be designed to allow connection of the processing unit 44 with additional safety devices connected to the safety circuits S.

Thus, the processing unit 44 may send data D associated with the state of the contacts of the detectors 14, 15 to the additional safety devices, and may control such contacts in accordance with the electric signals received from such additional safety devices.

The processing unit 44 may also be designed to selectively power an array of LEDs 46, which is adapted to generate a light emission whose wavelength and/or intensity varies according to the position of the pivotal part P of the barrier B relative to the stationary part M thereof.

Also, the switch 1 may comprise a pair of detectors 14, 15 of the same type, which are adapted to interact with respective pins 9, 10, as shown in the figures.

Alternatively, in a configuration of the invention that is not shown in the figures, the switch 1 may comprise a pair of detectors 14, 15 of different types, which are adapted to interact with respective pins 9, 10.

The type of detectors 14, 15 to be used may be selected according to the particular configuration of the safety circuits S.

Figure 13:
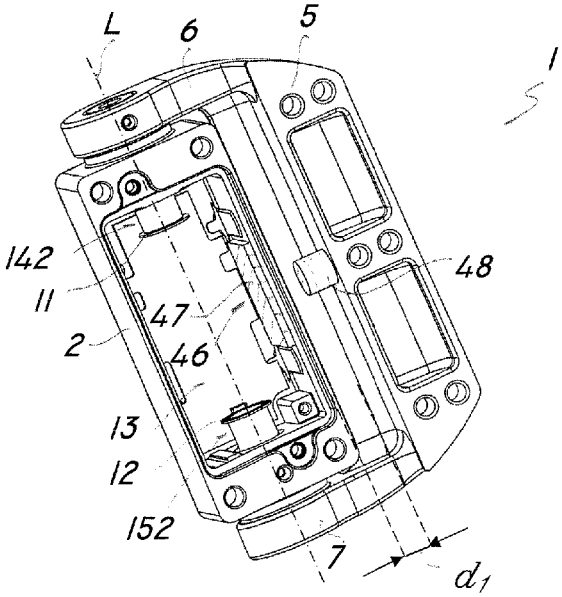
FIG. 13 is a schematized top view of a variant of the safety switch of the invention with a proximity sensor.

Conveniently, the switch 1 may comprise an additional proximity sensor 46, as schematically shown in FIG. 13, which has a passive member 47 associated with the fixed part 2 and an exciter member 48 fixed to the movable member 5.

The proximity sensor 46 may be adapted to generate an electric signal as a function of the relative distance $d_1$ between the fixed member 2 and the movable member 5 of the switch 1.

For example, the proximity sensor 46 may be selected from the group comprising magnetic Hall effect sensors.

Conveniently, the proximity sensor 46 may be used instead of one of the detectors.

Advantageously, the proximity sensor 46 may generate an enabling and/or disabling signal, for enabling/disabling the safety circuit S according to the instantaneous distance $d_1$ between the fixed member 2 and the movable member 5.

The processing unit 44 may be designed to receive the signal generated by the proximity sensor 46 and generate an alarm signal from an output, when the mutual distance $d_1$ between the fixed member 2 and the movable member 5 exceeds a predetermined threshold value.

However, when such distance is smaller than the threshold value, the processing unit may allow actuation of the detectors 14, 15 and transmission of the signals generated thereby into the safety circuits S.

The above disclosure clearly shows that the invention fulfills the intended objects and particularly provides a remarkably safe and versatile hinged safety switch.

The hinged safety switch of the invention is susceptible of a number of changes and variants, within the inventive principle disclosed in the appended claims. All the details thereof may be replaced by other technically equivalent parts, and the materials may vary depending on different needs, without departure from the scope of the invention.

While the hinged safety switch has been described with particular reference to the accompanying figures, the numerals are only used for the sake of a better intelligibility of the invention and shall not be intended to limit the claimed scope in any manner.

The invention claimed is:

1. A multi-signaling hinged safety switch for protection barriers (B) of machines or automatic plants, comprising:

a substantially box-shaped fixed member (2) which is designed to be secured to a stationary part (M) of a protection barrier (B), said box-shaped member (2) having a longitudinal axis (L) and a pair of axial end holes (3, 4);

a movable member (5) which is designed to be secured to a pivotal part (P) of the protection barrier (B) and has a pair of substantially transverse arms (6, 7) extending from said fixed member (2) and pivoted to said axial end holes (3, 4);

electric detection means (8) located within said box-shaped member (2) for switching one or more electric safety circuits (S) of the barrier (B) at a predetermined switching angle ($\alpha$); and a pair of cylindrical pins (9, 10) that extend in cantilever fashion from said arms (6, 7) and are pivotally inserted in said holes (3, 4), said pins (9, 10) having mutually spaced opposed ends (11, 12) defining a gap (13) with no axial connection member therein, wherein said detection means (8) comprise a pair of detectors (14, 15), each interacting with an end (11, 12) of a pin (9, 10) and having a switching angle ($\alpha$, $\alpha'$), and wherein said detectors (14, 15) are operatively independent from each other.

2. The switch as claimed in claim 1, wherein said detection means (8) are located within said gap (13).

3. The switch as claimed in claim 1, wherein said detectors (14, 15) are selected from the group consistinq of mechanical detectors (140, 150), electronic detectors, electromagnetic detectors (142, 152), and optical detectors (141, 151).

4. The switch as claimed in claim 1, wherein a substantially annular actuator (16, 17) is interposed between the end (11, 12) of each of said pins (9, 10) and a mechanical detector (140, 150).

5. The switch as claimed in claim 4, wherein said actuator (16, 17) has an end wall (18, 19) interacting with said mechanical detector (140, 150), said actuator (16, 17) being adapted to convert a rotary motion of said pin (9, 10) into an axial motion of said end wall (18, 19).

6. The switch as claimed in claim 5, further comprising means (30) for adjusting said switching angle ($\alpha$, $\alpha'$), which are interposed between said actuator (16, 17) and a pin (9, 10) to change an angular position of said end wall (18, 19) of said actuator (16, 17) relative to said pin (9, 10).

7. The switch as claimed in claim 6, wherein said adjustment means (30) comprise an annular member (31, 32) coaxial with said actuator (16, 17), said annular member (31, 32) having a flat surface (33) with a series of axial projections (35) arranged along a circumference (C) and adapted for selective engagement in corresponding recesses formed in a transverse end surface (36, 37) of said pin (9, 10).

8. The switch as claimed in claim 3, wherein said optical, electronic, or electromagnetic detector (141, 151; 142, 152) comprises a movable portion (240, 250) associated with the end (11, 12) of each pin (9, 10) and a fixed sensor (260, 270) which is designed to interact with said movable portion (240, 250) and to be secured to said box-shaped fixed member (2).

9. The switch as claimed in claim 1, further comprising an electronic processing unit (44) associated with said detection means (8) to generate a control signal which varies according to a number of commutations performed by said detectors (14, 15).

10. The switch as claimed in claim 9, wherein said electronic processing unit (44) is adapted to generate data (D) associated with an operation of said detection means (8).

11. The switch as claimed in claim 1, further comprising a proximity sensor (46) with a passive member (47) associated with the box-shaped member (2) and an exciter member (48) fixed to the movable member (5), said proximity sensor (46) being adapted to generate an electric signal which is a function of a relative distance ($d_1$) between said fixed member (2) and said movable member (5).

* * * * *